US007178907B2

(12) United States Patent
Hagen et al.

(10) Patent No.: US 7,178,907 B2
(45) Date of Patent: Feb. 20, 2007

(54) FLUID CONTAINMENT STRUCTURE WITH COILED BAG BACKPRESSURE REGULATOR

(75) Inventors: David M. Hagen, Corvallis, OR (US); Kevin D. Almen, Albany, OR (US); David J. Benson, Albany, OR (US); Anthony D. Studer, Albany, OR (US); Cary R. Bybee, Lebanon, OR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 233 days.

(21) Appl. No.: 10/833,211

(22) Filed: Apr. 27, 2004

(65) Prior Publication Data

US 2005/0237367 A1 Oct. 27, 2005

(51) Int. Cl.
*B41J 2/17* (2006.01)
*B41J 2/175* (2006.01)

(52) U.S. Cl. ..... 347/84; 347/85; 347/86

(58) Field of Classification Search ..... 347/84–89
See application file for complete search history.

(56) References Cited

U.S. PATENT DOCUMENTS

| | | | | |
|---|---|---|---|---|
| 5,368,802 | A | 11/1994 | Wanha | |
| 5,409,134 | A * | 4/1995 | Cowger et al. | 222/1 |
| 5,541,632 | A | 7/1996 | Khodapanah et al. | |
| 5,871,784 | A | 2/1999 | Assink et al. | |
| 5,975,686 | A | 11/1999 | Hauck et al. | |
| 6,499,838 | B2 * | 12/2002 | Seccombe et al. | 347/85 |

* cited by examiner

*Primary Examiner*—Lamson Nguyen
*Assistant Examiner*—Lisa M. Solomon

(57) ABSTRACT

A fluid containment structure includes a containment vessel having an interior fluid chamber for fluid containment. A flexible bag is disposed within the containment vessel; the bag is vented to the external atmosphere outside the containment vessel. A spring is coupled to the bag to hold the bag in a coiled state until a back-pressure within the fluid chamber exerts sufficient force to commence uncoiling the bag against the spring pressure, allowing air from the external atmosphere to enter the bag and enlarge an interior bag space which is sealed from the interior fluid chamber.

3 Claims, 4 Drawing Sheets

FLUID CONTAINMENT STRUCTURE WITH COILED BAG BACKPRESSURE REGULATOR

BACKGROUND

Fluid containment structures which generate back-pressure are used in applications such as ink-jet fluid supplies and print cartridges. A back-pressure, i.e. a negative fluid pressure at a fluid outlet, is employed to provide proper system pressures and prevent fluid from drooling from fluid outlets or fluid nozzles. There is a need for backpressure generating mechanisms that are reliable and are cost-effective to produce.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
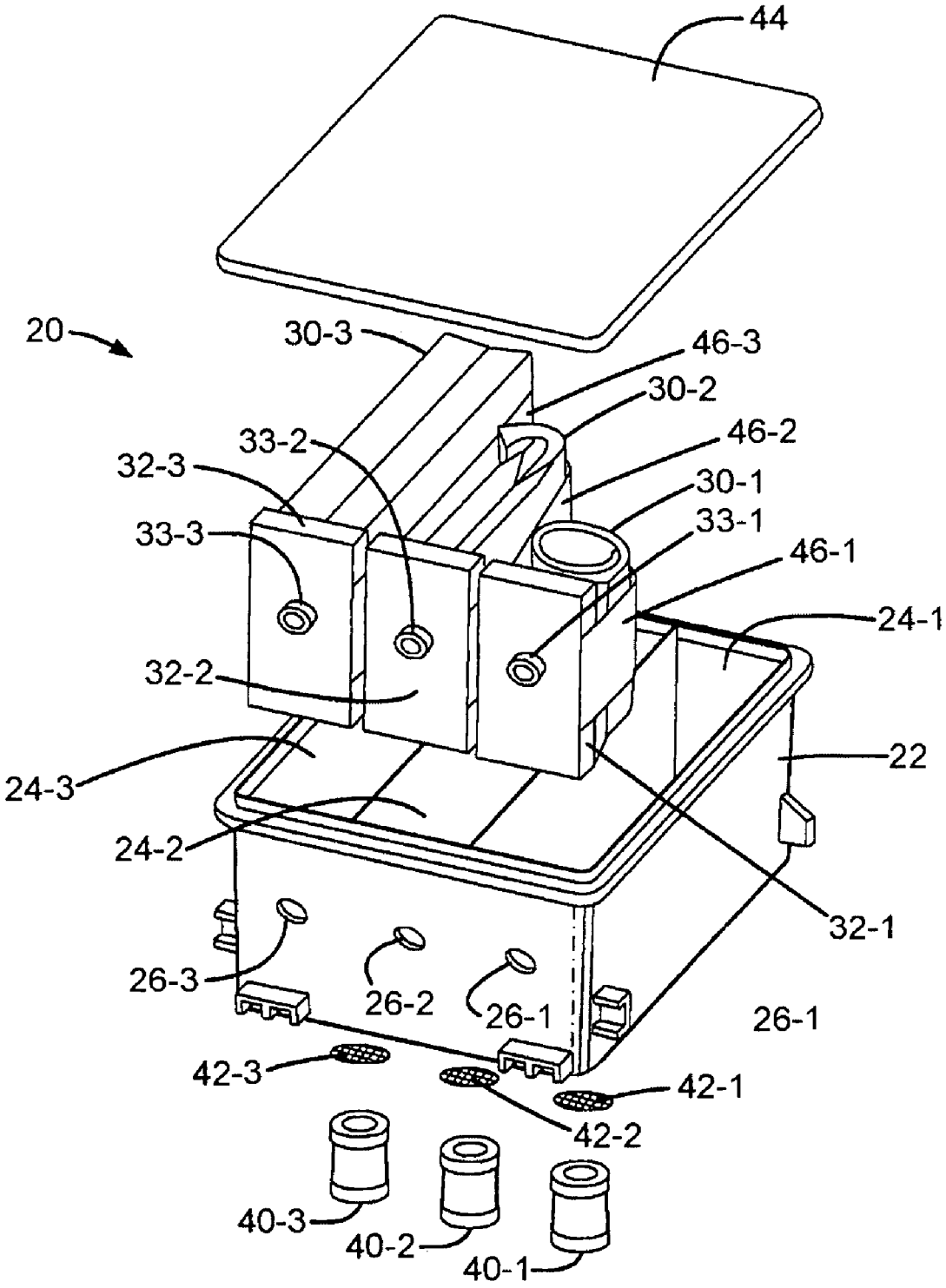
FIG. 1 is an isometric exploded view of an exemplary embodiment of a fluid supply with coil spring bag structures for each fluid chamber for backpressure regulation.

In the following detailed description and in the several figures of the drawing, like elements are identified with like reference numerals.

An exemplary embodiment of a fluid containment structure is for a backpressure-generating, free ink based replaceable fluid supply. In an exemplary application, the supply is used to store and supply ink for an inkjet printing system. An exemplary embodiment of a fluid supply 20 is illustrated in FIG. 1, and includes a tri-chambered containment vessel 22 defining three interior fluid chambers 24-1, 24-2, 24-3. Thin membrane bags 30-1, 30-2, 30-3 are positioned in the respective fluid chambers of the vessel. Each bag is vented to the outside atmosphere through a corresponding vent hole 33-1, 33-2, 33-3 in a plastic fitment 32-1, 32-2, 32-3 which is sealed to the respective bag. The periphery of each fitment is sealed to the vessel wall with the fitment hole in fluid communication with a corresponding hole 26-1, 26-2, 26-3 in the vessel wall, so that only the exterior of each bag is exposed to the corresponding fluid chamber 24 of the vessel.

A fluid interconnect (FI) 40-1, 40-2, 40-3, e.g. an open foam/screen, or septum for a needle septum interface system, with a corresponding bubble screen 42-1, 42-2, 42-3, provides fluid communication between the outside of the housing and the respective fluid chambers 24-1, 24-2, 24-3. In one embodiment, the screen is a stainless steel mesh filter with a nominal 40 micron opening size to provide bubble protection. A cover 44 attaches to the vessel body 22 to seal the fluid chambers from each other as well as from the atmosphere.

The bags may be fabricated of a non-elastic bag material. In an exemplary embodiment, the bag material is a single or multilayer film that has good air barrier water vapor transmission rate (WVTR) properties. An exemplary embodiment is a multilayer barrier film consisting of Polyethylene (E)+Ethylene Vinly Alcohol (EVOH)+Polyethylene Terephthalate (PET). An exemplary film thickness is typically in the range of 0.8 mils to 4 mils (0.02 mm to 0.1 mm), in an exemplary embodiment.

In an exemplary embodiment, the bag is an assembly of film parts, forming a pleated bag assembly which in an unfurled, deployed state has a form factor approximating that of the corresponding fluid chamber in which the bag is installed. Heat staking can be employed to join the film pieces together. Based on the geometry of the fluid containment vessel, spring/bag assembly can be designed to maximize the efficiency with respect to the delivered volume.

A coil spring member 46-1, 46-2, 46-3 is coupled to each bag, so that the spring force of the spring coils the bag into a relatively small roll in a fully collapsed, furled state. Bag 30-1 (FIG. 1) is shown in the furled state. In this state, there is little or no air contained within the bag. The spring force or tension tends to maintain the bag in this furled state. The steel spring can be fabricated by bending, stamping, rolling, notching or otherwise shaped to meet the application requirements.

In one exemplary embodiment, the coiled spring is formed from a 0.03 mm thick, ½ inch (12.7 mm) width stainless steel spring stock, that is staked by heat/pressure to the outside of the bag, with an unrolled length of two inches (5.08 cm). The spring dimensions can be varied to address desired pressure ranges or reservoir/bag geometries. The spring may be attached to the bag in an uncoiled state; when the spring is released, the bag and spring coil up in an furled condition. In another embodiment, the spring is placed inside the bag, effectively winding the spring and bag simultaneously while preventing the ink from coming into contact with the spring. This allows selection of a spring material without consideration of any effect of ink or other fluid on the spring material. Other suitable spring materials include, for example and without limitation, Aluminum, Titanium, thermoplastic elastomers (TPE), and rubber. In either case, the spring and bag coil after assembly, and are then assembled into the fluid chamber of the supply. Other techniques for coupling the spring to the bag include coating the spring with PE/PP (Polyethylene/Polypropylene), and heat staking the coated spring to the bag. This alternate technique protects the bag from sharp spring edges. Another assembly technique is to place the spring in the bag with a through hole in the spring through which the two sides of the bag could be staked together, or, with the spring outside the bag, wrapping the end of the bag around the end of the spring and staked to itself through the hole in the spring end. The bag could also be adhesively bonded to the spring. If the correct geometries are used, the spring may not be bonded to the spring at all. This may be of particular relevance to single use products, in which bag wear from the spring is not a significant factor.

The fitment is attached to the vessel wall, base or lid, e.g. by adhesive, by staking, by welding or by press-fitting. For press-fit attachment, the fitment and vessel wall, base or lid are designed with male/female features which have an interference fit such that compressive forces form a hermetic seal. The fitment size can be reduced to maximize fluid volume, and the fitment can be attached to the bag in different orientations from that illustrated in the drawings.

The fluid chambers of the supply 20 are filled with ink, either through the open tops of the chambers before the lid is attached, or through fill ports made in a housing wall or lid. The fill ports can be sealed with a seal element, e.g. a ball, after ink has been filled into the fluid chambers. After fluid filling, a small quantity of ink can be pulled through the FI, creating negative pressure in the sealed fluid chambers, e.g. in one embodiment, on the order of 1–2 inches of water negative pressure. This vacuum forces atmospheric pressure into the bags through the respective vents 33-1, 33-2, 33-3, and the coil begins to unwind, creating the initial back pressure for the supply 20. The tension of the coiled spring maintains a negative pressure throughout the life of the supply.

An alternate technique to create an initial backpressure is to slightly fill or pressurize the inside of the bag with air during ink fill. This initial pressurization can be through the vent, e.g. vent 33-1, and will slightly unwind the spring/bag assembly. After ink fill is completed, the applied vent pressure can be released, allowing spring tension to maintain backpressure with the ink reservoir.

Consider the case in which the fluid supply 20 is used as an ink supply for a printer, and the fluid is liquid ink. With the supply 20 connected to a printer, and a fluid path created between the supply and a printhead such as an inkjet printhead, as ink is consumed by printhead operation, the negative pressure inside the supply fluid chamber increases until the pressure on the bag overcomes the spring force tending to coil the bag. When this occurs, atmospheric pressure acting through the vent (e.g. vent 33-1) into the bag causes the coiled bag/spring assembly (e.g., comprising bag 30-1 and spring 46-1) to begin to unwind, maintaining the initial backpressure for the supply. Fractional volume from the bag is released, air enters this fractional volume through the vent 33-1, and the back pressure drops to a lower level. Thus, volume is exchanged between the extracted fluid and the expanding, unfurling bag. The tension of the coiled spring maintains a negative pressure. This process repeats throughout the life of the supply to keep the backpressure within an acceptable range until the bag volume is maximized. As the supply fluid drains, the un-coiled bag assembly consumes nearly all the emptied volume of the fluid chamber. At both the beginning and end of life the supply is robust during altitude or temperature excursions because of the minimal volume of air inside the fluid chambers of the supply. In an exemplary embodiment, the supply can tolerate use in high altitudes, e.g. fourteen thousand feet in elevation.

In an exemplary embodiment, the supply does not employ a bubble generator, or a capillary material such as foam. With the bag optimized to fit the fluid generator volume in an unfurled condition, the volume of stranded ink at the end of life can be reduced, e.g. in one embodiment the stranded ink is at or less than 9% of the fluid chamber volume.

Figure 2A:
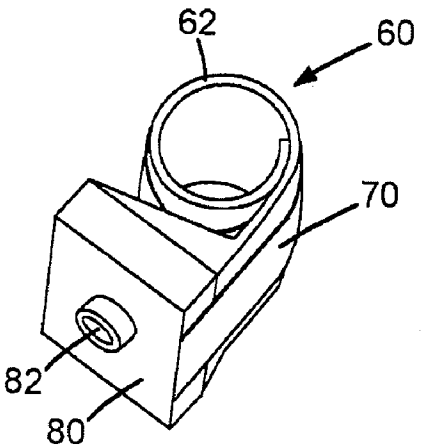
FIG. 2A is an isometric view of an exemplary embodiment of a coil spring bag assembly in a natural coiled state.

FIG. 2A is an isometric view of an exemplary embodiment of a coil spring bag assembly 60 in a natural, furled state. This embodiment has a form factor sized to fit a single chamber fluid supply. The assembly includes the bag 62, the coil spring 70 and a fitment 80 having an opening 82 formed therein to provide a vent to atmosphere for the bag. The supply housing is not shown in FIG. 2A. The coil spring is rigidly attached to the fitment and to the distal end of the bag material. The spring can also be attached to the bag at points intermediate the fitment and distal end of the bag, or along the full length of the bag. FIG. 2A illustrates the natural state due to the coil spring tension. After filling the supply with ink, the supply can be primed by withdrawing a small amount of ink through the FI to engage the spring and provide backpressure. Priming is typically done during manufacture. The FI can be sealed with tape or a cap. After removal of the tape or cap by the user and installation in a printing system, the backpressure can be maintained by bubble pressure at the printhead nozzles or supply FI.

Figure 2B:
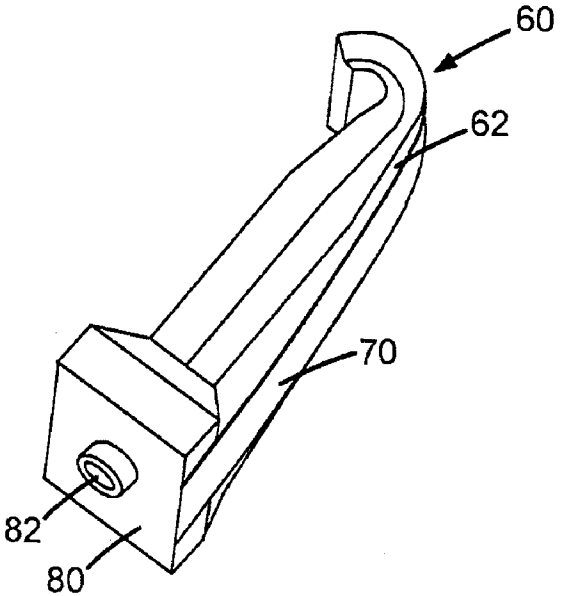
FIG. 2B shows the coil spring bag assembly in a partially uncoiled state.

FIG. 2B shows the coil spring bag assembly in a partially uncoiled state. This is a state in which the fluid supply is partially depleted of its ink supply. As ink is withdrawn from the supply, the bag will inflate by drawing air through the fitment hole 82. The spring will begin to uncoil while opposing the inflation of the bag, providing backpressure to prevent drooling. The backpressure range will depend on the desired range of operation for a given application. In one exemplary embodiment, the backpressure range is in the range of 1 to 10 inches of water. An exemplary pleat 64 in the bag is visible in FIG. 2C.

Figure 2C:
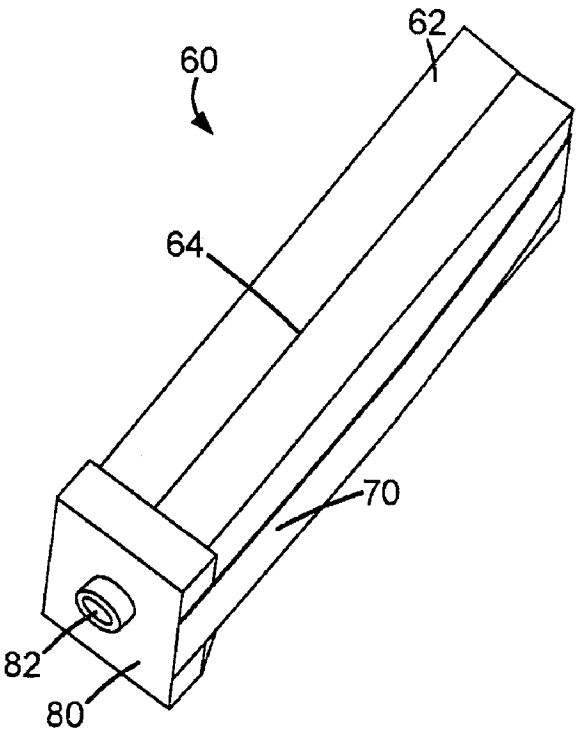
FIG. 2C shows the coil spring bag assembly in a fully uncoiled state.

FIG. 2C shows the coil spring bag assembly in a fully uncoiled state. Near the end of life for the supply, the spring becomes fully uncoiled, and the bag has inflated to nearly fill the fluid chamber of the supply. By form fitting the bag to fill the fluid chamber when inflated as closely as possible, the amount of ink withdrawn from the supply is maximized, minimizing the volume of stranded ink. Since no air is ingested into the fluid chamber, altitude excursions during life tend not to pose significant leakage problems.

Figure 3:
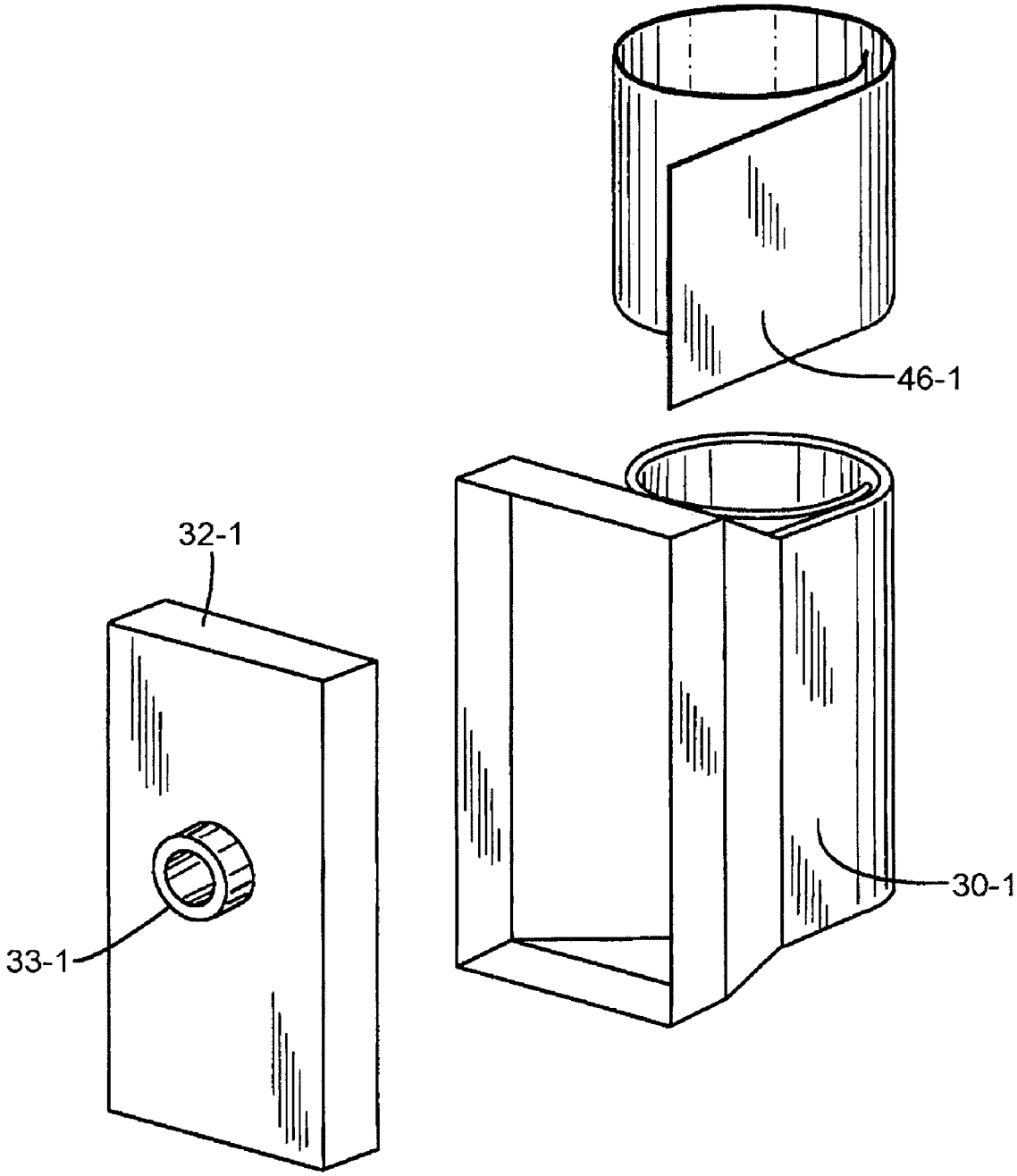
FIG. 3 is a simplified isometric exploded view of an exemplary embodiment of a coil spring bag assembly

FIG. 3 is a simplified isometric exploded view of an exemplary embodiment of a coil spring bag assembly, showing the fitment 32-1 with vent opening 33-1, bag 30-1 and coil spring 46-1.

Figure 4:
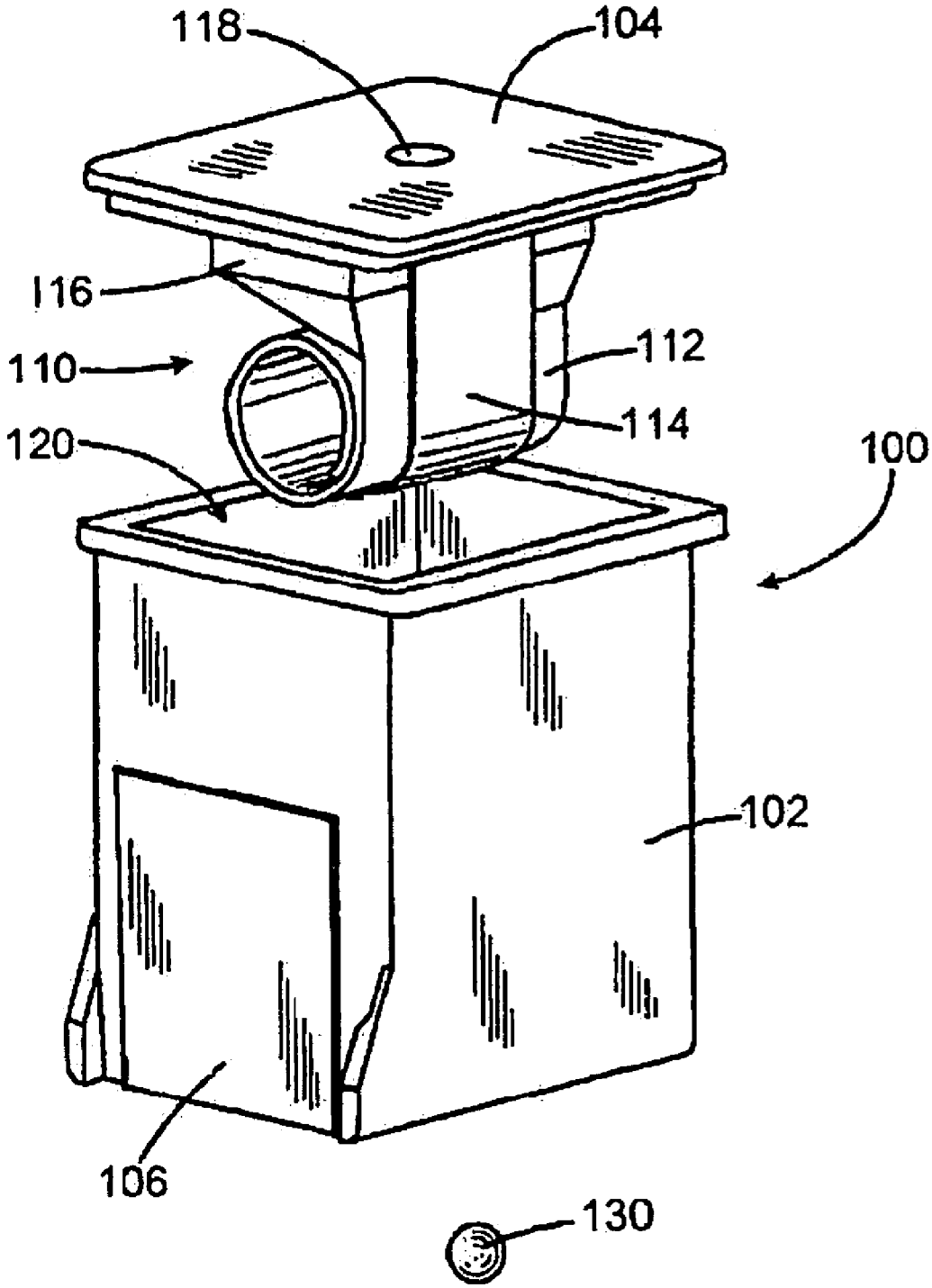
FIG. 4 is a partially exploded view of an embodiment of a print cartridge with a coil spring backpressure generator.

The coil spring back pressure generator structure can be used in other applications. For example, FIG. 4 shows an exemplary print cartridge 100 in a partially exploded view. The cartridge includes a body structure 102 which has formed therein a fluid chamber 120. Attached to the body structure is a TAB head assembly (THA) 106 which includes electrical interconnects, firing chambers and associated electronics, and an orifice plate which defines printhead nozzles. The THA 106 in an exemplary embodiment can be a well known assembly as used in thermal inkjet printhead, or other types of structures, e.g. piezoelectric printhead assemblies. The firing chambers are fed with ink from the fluid chamber 120, and ink drops are ejected from the firing chambers in response to electrical signals applied to the printhead THA interconnects. As the ink drops are ejected, ink is drawn from the fluid chamber to refill the firing chambers.

To maintain negative pressure within the fluid chamber and thus prevent ink drooling from the nozzles during ordinary use, a backpressure generating structure 110 is used. The structure 110 includes an inflatable bag 112 and a coil spring 114, attached to a fitment structure 116. In this exemplary embodiment, the fitment is press-fitted to the lid 104, although other attachment techniques can alternatively be employed, as with the fitment 32-1, 32-2, 32-3 as described above. The bag 112 is sealed with respect to the fluid chamber, and communicates with the external atmosphere through a vent 118 formed through the lid 104 and the fitment 116. In some embodiments, the bag and spring may be attached directly to the lid structure without a separate fitment structure.

Ink or other operating fluid can be dispensed into the fluid chamber through the open top of the fluid chamber, or preferably after the lid and backpressure generating structure have been assembled and sealed to the body structure, through a fill port (not shown in FIG. 4). After the chamber has been filled with fluid, the fill port can be sealed with a seal member 130, e.g. a ball.

The backpressure generating structure 110 operates in an similar fashion to that described above with respect to the embodiments of FIGS. 1–3. Initially, the bag is in a furled condition, with an initial backpressure created within the chamber 120, e.g. by ejecting or drawing some ink through the nozzles. In operation of the print cartridge, as fluid is ejected from the nozzles and the firing chambers are refilled with fluid from the fluid chamber, the backpressure within the fluid supply will increase. The increase in back pressure will tend to commence unfurling the bag 112, and air will enter through the vent into an incrementally expanding open space in the bag, thus relieving some backpressure. The coil spring 114 opposes the unfurling, maintaining a negative pressure within the fluid supply within an operating range, e.g. a range of 1 to 10 inches of water. This unfurling will continue as the fluid is ejected from the nozzles, until the bag has fully unfurled, and the free fluid within the chamber is depleted.

Although the foregoing has been a description and illustration of specific embodiments of the invention, various modifications and changes thereto can be made by persons skilled in the art without departing from the scope and spirit of the invention as defined by the following claims.

What is claimed is:

1. A fluid containment structure, comprising:

a containment vessel having an interior fluid chamber for fluid containment;

a flexible bag disposed within the containment vessel, said bag vented to an external atmosphere outside the containment vessel;

a spring structure coupled to the bag to hold the bag in a coiled state until a back-pressure within the fluid chamber exerts sufficient force to commence uncoiling the bag, allowing air from the external atmosphere to enter the bag and enlarge an interior bag space which is sealed from the interior fluid chamber, and wherein said spring structure is disposed within said bag, and does not contact fluid in the fluid chamber.

2. A fluid containment structure, comprising:

a containment vessel having an interior vessel space for fluid containment;

means for regulating a negative fluid pressure within said vessel space, said means comprising a bag disposed within the containment vessel, said bag vented to an external atmosphere outside the containment vessel, and a spring means coupled to a side surface portion to urge the bag in an initial coiled bag state, said spring means for restraining the bag in the initial coiled state until a sufficient back-pressure within the interior space exerts sufficient force to allow air from the external atmosphere to enter the bag and enlarge an interior bag space sealed from the fluid chamber to regulate the negative pressure within the interior vessel space until a maximum bag space is reached;

wherein the spring means comprises a coil spring;

and wherein said coil spring is disposed within said bag, and does not contact fluid in the fluid chamber.

3. A fluid supply for an ink jet printer, comprising:

a containment vessel having an interior fluid chamber for fluid containment;

a fluid interconnect communicating with the fluid chamber;

a flexible bag disposed within the containment vessel, said bag vented to an external atmosphere outside the containment vessel;

a coil spring coupled to the bag to hold the bag in a coiled state until a back-pressure within the fluid chamber exerts sufficient force to commence uncoiling the bag against the spring pressure, allowing air from the external atmosphere to enter the bag and enlarge an interior bag space which is sealed from the interior fluid chamber, the spring opposing said uncoiling to maintain a negative pressure in said fluid chamber;

and wherein said coil spring is disposed within said bag, and does not contact fluid in the fluid chamber.

* * * * *

UNITED STATES PATENT AND TRADEMARK OFFICE

CERTIFICATE OF CORRECTION

PATENT NO. : 7,178,907 B2
APPLICATION NO. : 10/833211
DATED : February 20, 2007
INVENTOR(S) : David M. Hagen et al.

It is certified that error appears in the above-identified patent and that said Letters Patent is hereby corrected as shown below:

On the face page, in field (73), in "Assignee" in column 1, line 2, delete "LP." and insert -- L.P. --, therefor.

Signed and Sealed this

Second Day of December, 2008

JON W. DUDAS
*Director of the United States Patent and Trademark Office*